US006173665B1

(12) United States Patent
Sekine

(10) Patent No.: US 6,173,665 B1
(45) Date of Patent: Jan. 16, 2001

(54) SEWING MACHINE CONTROL SYSTEM

(75) Inventor: Kiyokazu Sekine, Mie-ken (JP)

(73) Assignee: Brother Kogyo Kabushiki Kaisha, Aichi-ken (JP)

( * ) Notice: Under 35 U.S.C. 154(b), the term of this patent shall be extended for 0 days.

(21) Appl. No.: 09/176,590

(22) Filed: Oct. 21, 1998

(30) Foreign Application Priority Data

Oct. 22, 1997 (JP) ..... 9-309344

(51) Int. Cl.[7] ..... D05B 21/00; D05C 9/04
(52) U.S. Cl. ..... 112/102.5; 112/475.19
(58) Field of Search ..... 112/102.5, 470.04, 112/470.06, 445, 475.19, 155, 470.01; 364/470.09

(56) References Cited

U.S. PATENT DOCUMENTS 4,870,916 * 10/1989 Kozawa ..... 112/470.04 X
5,438,520 * 8/1995 Satoh et al. ..... 112/102.5 X
5,474,000 * 12/1995 Mizuno et al. ..... 112/102.5

* cited by examiner

*Primary Examiner*—Peter Nerbun
(74) *Attorney, Agent, or Firm*—Kane, Dalsimer, Sullivan, Kurucz, Levy, Eisele and Richard, LLP

(57) ABSTRACT

In an embroidery sewing machine, a value setting screen on a display indicates parametrical items about the movement of an embroidering frame, i.e., "sewable area" and "stand-by position", as well as parametrical items about the sewing operation, i.e., "thread-breakage sensitivity" and "number of stitch-back stitches". An operator enters or designates optimum values for those parametrical items by operating numerical keys and cursor moving keys on a keyboard, and registers a name to be assigned to a set of values for those parametrical items. The set of values for those parametrical items are stored in a floppy disk in relation to the registered name. By simply designating one of the registered names correspondingly to a material to be sewn, the optimum values for the parametrical items are retrieved simultaneously and set for the sewing operation.

27 Claims, 5 Drawing Sheets

| | |
|---|---|
| CONTENT OF FIRST GROUP | NAME " T-SHIRT (L)" |
| | SEWABLE AREA "(pa,pb,pc,pd) |
| | STAND-BY POSITION (pe) |
| | THREAD-BREAKAGE SENSITIVITY "3" |
| | NUMBER OF STITCH-BACK STITCHES "5" |
| CONTENT OF SECOND GROUP | NAME". . . . " |
| | SEWABLE AREA "(pa,pb,pc,pd) |
| | STAND-BY POSITION (pe) |
| | THREAD-BREAKAGE SENSITIVITY "A" |
| | NUMBER OF STITCH-BACK STITCHES "B" |
| | |

SEWING MACHINE CONTROL SYSTEM

BACKGROUND OF THE INVENTION

1. Field of the Invention

The present invention relates to a control system for sewing machines, and more particularly to a technique to simplify the setting of values for various parametrical items on the material-feeding and sewing operations depending on a kind of a material to be sewn, e.g., a sweat shirt and a T-shirt.

2. Description of Related Art

An embroidery sewing machine is provided with an embroidering unit or device to drive and move an embroidering frame to which a material (i.e., a sweat shirt, a T-shirt or the like) is set. Prior to the sewing operation, the embroidering frame that is conformed in size and configuration to a pattern to be embroidered is attached to the embroidering device. A desired embroidery pattern is selected, and to form the selected embroidery pattern by stitches an operator sets various parametrical items on the material-feeding and sewing operations in terms of setting values while viewing its related display on a monitor screen. Examples of those parametrical items are "sewing speed", "sewable area" within the embroidering frame, "stand-by position" of the embroidering frame, "thread-breakage sensitivity", and "number of stitch-back stitches" for the thread breakage.

A value to be set for the parametrical item "sewing speed" is the number of stitches formed per minute. A value to be set for the parametrical item "sewable area" is positional data indicative of two points (i.e., the left upper point and the right lower point) that designate within the embroidering frame an area (a sewable area) where an embroidery pattern can be sufficiently formed by stitches. A value to be set for the parametrical item "stand-by position" is positional data indicative of a position (a stand-by position) to which the embroidering frame is retracted so that the sewed material can be easily removed from the embroidering frame after the sewing operation is complete. A value to be set for the parametrical item "thread-breakage sensitivity" is the number of stitches for a thread-breakage sensitivity to determine whether or not a thread breakage sensed by a sensor is reliable. A value to be set for the parametrical item "number of stitch-back stitches" is the number of stitches by which a needle is to be returned corresponding to the number of idle stitches subsequent to the thread breakage.

Those parametrical values are set according to a kind of a material to be sewn or the size of an embroidery pattern. The "sewing speed", "thread-breakage sensitivity" and "number of stitch-back stitches" are set in terms of corresponding numerical values. The "sewable area" and the "stand-by position" are set using a "cursor" or a "marker" on the screen of the display device or monitor.

As described above, to embroider the material with the embroidery sewing machine, preparatory work is required. That is, every time the material is embroidered, the material, (e.g., a sweat shirt or a T-shirt) is set to the embroidering frame, a desired embroidery pattern is selected, and optimal values are set for the plurality of the parametrical items in accordance with a kind of the material and the size of the embroidery pattern. Therefore, when the material is changed, for example, from a sweat shirt to a T-shirt or vice versa, a machine operator sets again the optimal values for the parametrical items anew. In a case where the material is frequently changed, this complicated value setting work is troublesome and lowers the working efficiency.

SUMMARY OF THE INVENTION

Accordingly, an object of the present invention is to simplify and quicken the work to set the optimal values of the parametrical items as the sewing conditions on the material-feeding and sewing operations, and hence to improve the efficiency of sewing work.

To achieve the above object, a control system is provided for a sewing machine having input means for inputting characters, symbols and various commands, display means including a display unit, material feeding means for feeding a material to be sewn, sewing means for sewing the material, and control means for controlling the display means, the material feeding means, and the sewing means.

The control system includes:

value setting means for setting a value of each group for at least one parametrical item with respect to at least one of material feeding and sewing operations using the input means and said display means;

name registering means for registering a name assigned to the value of the each group for the at least one parametrical item using the input means and the display means;

value storing means for storing the value of the each group for the at least one parametrical item in relation to the name thus registered by the registering means;

name selecting means for selecting one of a plurality of names, each of said plurality of names being stored in the storing means in relation of the values of a corresponding group for the at least one parametrical item; and retrieving means for retrieving, from the storing means, the value of a group corresponding to the selected name for the at least one parametrical item.

At least one parametrical item with respect to at least one of material-feeding and sewing operations is set a value of a group distinguished from another group. That is, the value setting means sets a value for at least one parametrical item with respect to the sewing condition group by group using the input means and the display means. The name registering means registers a name assigned to the value of each group for the at least one parametrical item set by the value setting means using the input means and the display means. The value storing means stores the value of the each group for the at least one parametrical item and the name assigned thereto together in a corresponding fashion. The value storing means may be a writable floppy disk, a hard disk, a nonvolatile memory, e.g., a flash memory, contained in or mountable to the machine, a computer connected to the machine, or the like.

The name selecting means can cause the display means to display a list of the names, which have been already stored in the storing means as respective groups. The name selecting means selects a desired or appropriate one of the names depending on a sewing condition. The retrieving means reads out or retrieves, from the storing means, the value of a group for the at least one parametrical item, to which the selected name is assigned. The retrieved value of the group and the name assigned thereto may be displayed on the screen of the display means in association with the at least one parametric item. The value of each group for at least one parametrical item on the material feeding and the sewing operations is stored in association with name assigned to the group. Therefore, the set value for at least one parametrical item, which is the most appropriate to a material to be sewed, can be read out all at one time by merely selecting the name, so that the desired value is set for the at least one parametrical item.

The control system may further includes transferring means for transferring the value of the group for at least one parametrical item, that are retrieved by the retrieving means, to the control means. With the transferring means, the control means can use the set value of the group for at least one parametrical item to control the sewing means, thereby executing a sewing process.

The sewing machine is, preferably, an embroidery sewing machine capable of forming stitches of an embroidery pattern on the material that is set to the embroidering frame. In this case, it is possible to set the value for at least one parametrical item required for forming stitches of an embroidery pattern on the material by the embroidery sewing machine. For example, the value for at least one of parametrical items restricting a movable range of the embroidering frame and defining the movement of the embroidering frame during embroidering operation can be set. Further, the set value can be readily retrieved by simply selecting the name assigned to the group for the at least one parametrical item.

The at least one parametrical item, the value for which is set and grouped, preferably includes an item to specify a sewable area within the embroidering frame and an item to specify a stand-by position of the embroidering frame after the sewing operation is complete. This can eliminate the necessity of a complicated setting work for those parametrical items.

The at least one parametrical item, the value for which is set and grouped, preferably includes an item to specify the number of stitches to define a thread-breakage sensitivity, and an item to specify the number of stitch-back stitches subsequent to the interruption of the sewing operation due to a thread breakage. This can also eliminate the necessity of a setting work for the those parametrical items.

The present invention further provides a method of setting a sewing condition and a method of handling the sewing condition. These methods, taken alone or in combination, can be applied to a sewing machine, a controller for a sewing machine, or the like to provide improved utility in setting and/or retrieving necessary values.

The present invention further provides a storage medium in which a program for executing a method of controlling a sewing machine according to the present invention is stored. The storage medium is useful to expand the function of a sewing machine, a controller for a sewing machine, or the like by installing the program therein.

The present disclosure relates to the subject matter contained in Japanese patent application No. Hei. 9-309344 (filed on Oct. 22, 1997) which is expressly incorporated herein by reference in its entirety.

DETAILED DESCRIPTION OF THE PREFERRED EMBODIMENT

The preferred embodiment of the present invention will be described with reference to the accompanying drawings.

In the description to be given hereunder, the present invention is incorporated into a multi-head embroidery sewing machine provided with three embroidering units. The embroidering units are respectively provided with cylinder beds. In each cylinder bed, a rotary hook as a loop taker is driven to rotate by a hook drive motor that is provided independently of a sewing machine motor.

Figure 1:
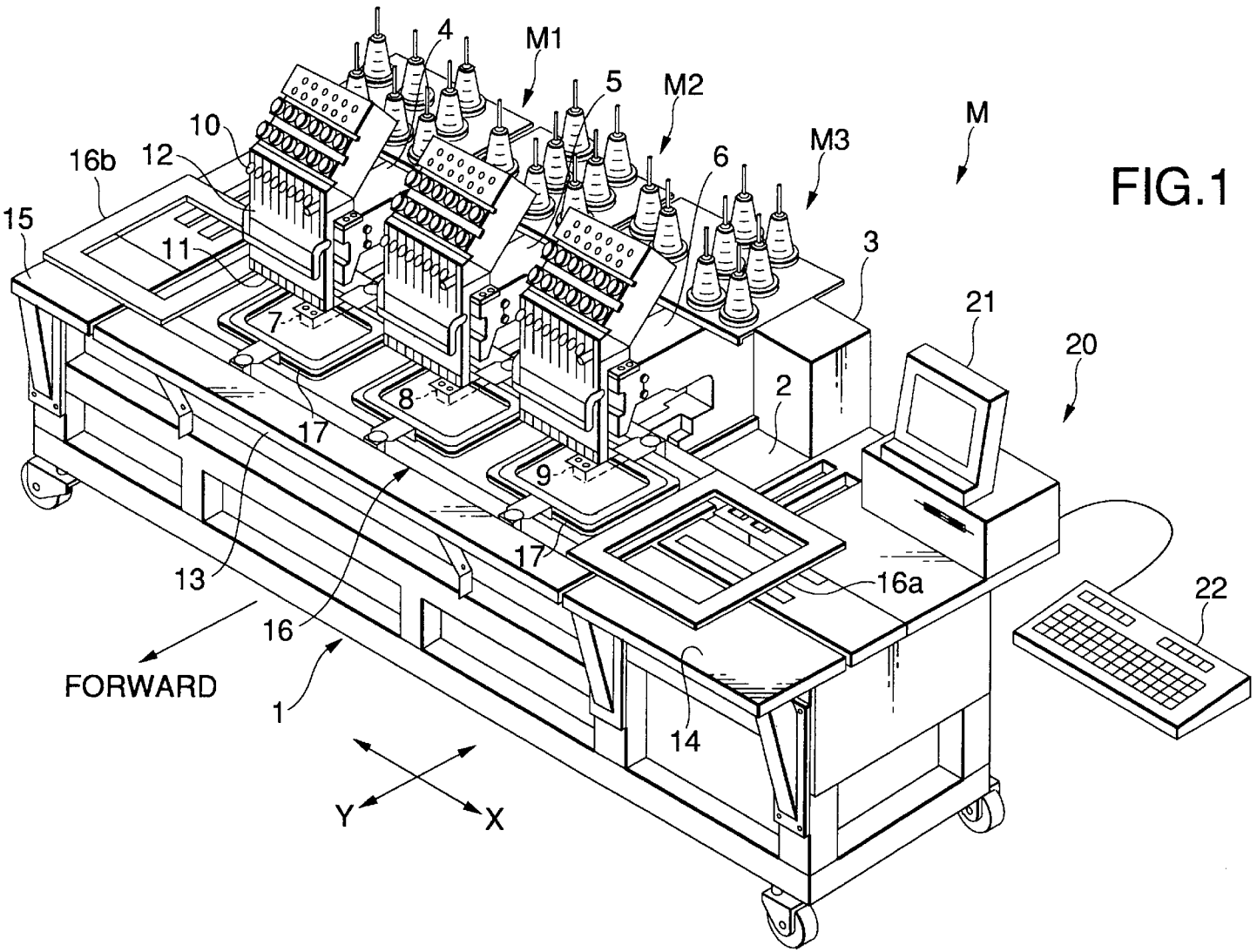
FIG. 1 is a schematic perspective view showing a multi-head embroidery sewing machine, which is an preferred embodiment of the present invention.

Reference is made to FIG. 1. The multi-head embroidery sewing machine is denoted as M. As shown, the sewing machine M includes a base frame 1 that extends laterally (in an X-axis direction). A machine support plate 2 is disposed on the rear side of the base frame 1. The machine support plate 2 is rectangular in a plan view, and has a predetermined length in the lateral direction. A support frame 3 stands on the rear portion of the machine support plate 2 to extend horizontally. Three head portions 4 to 6 are juxtaposed on the support frame 3 laterally at predetermined intervals. The base frame 1 located at the front end of the machine support plate 2 supports the rear ends of cylindrical bed portions 7 to 9. The cylindrical bed portions 7 to 9 are constructed in the form of bed units, and correspond to the head portions 4 to 6, respectively.

Thus, three embroidering units M1 to M3 are juxtaposed, which respectively include the head portions 4 to 6 on the support frame 3 and the separated bed portions 7 to 9. A needle bar case 12 is laterally movably supported on the front end of each of the headportions 4 to 6 of the embroidering units M1 to M3. The needle bar case 12 vertically movably supports nine needle bars that are arranged laterally in a row. The needle bar case 12 also supports nine thread take-up levers 10 in a swingable manner. Sewing needles 11 are attached to the lower ends of the needle bars, respectively. The needle bar cases 12 can be simultaneously moved in the lateral direction by a needle-bar changing mechanism (not shown) driven by a needle-bar changing motor 49 (FIG. 2) to change the needle threads of one color to those of another color. Needle-bar jumping mechanisms (not-shown) are provided on the head portions 4 to 6, respectively, for forcibly jumping the needle bars being driven to their upper positions.

A work table 13 is laterally disposed on the front side of the machine support plate 2 in a state that it is flush with the upper surfaces of the bed portions 7 to 9. A movable frame 16 rectangular in a plan view extends horizontally over an area where the work table 13 and auxiliary tables 14 and 15 on both sides of the work table 13 are provided. Embroidering frames 17 are attached to the movable frame 16 so as to correspond to the embroidering units M1 to M3, respectively.

A drive frame 16*a* at the right end of the movable frame 16 is driven to move in a direction parallel to the X-axis direction (in the right-and-left direction) by an X-axis drive mechanism (not shown), whereas the drive frame 16*a* and a drive frame 16*b* at the left end of the movable frame 16 are both driven to move in a direction parallel to the Y-axis direction (in a back-and-forth direction) by a Y-axis drive mechanism (not shown).

Figure 2:
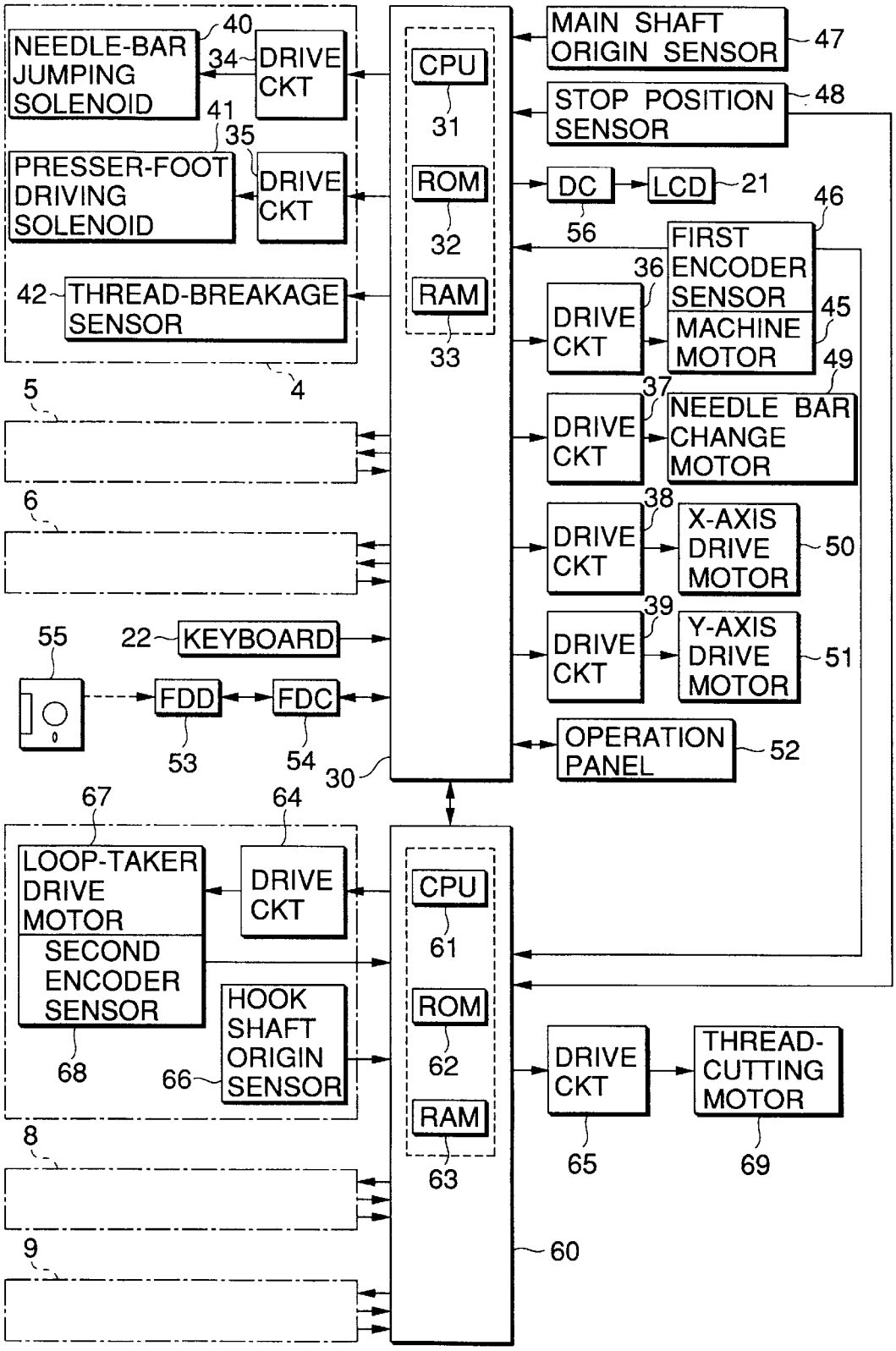
FIG. 2 is a block diagram showing a control system for the multi-head embroidery sewing machine of FIG. 1.

Therefore, the movable frame 16 is movable on and along an X-Y plane by the cooperation of the X-axis drive mechanism driven by an X-axis drive motor 50 (FIG. 2) and the Y-axis drive mechanism driven by a Y-axis drive motor 51 (FIG. 2). A control box 20 for controlling the operations of the multi-head embroidery sewing machine M is located behind the auxiliary table 14. A display device 21 and a keyboard 22 are connected to the control box 20. An operation panel 52 (FIG. 2) is further provided which includes a power switch, other various switches, and indicator lamps. The drive motors 50 and 51, and the X-axis and Y-axis drive mechanisms constitute a material-feeding mechanism for moving the movable frame 16 and the embroidering frames 17.

Each of the bed portions 7 to 9 is formed as a cylindrical bed unit extending in the back-and-forth direction. A module including a rotary hook (not shown) and a loop-taker drive motor 67 as a pulse motor for driving the rotary hook is attached to the front end of each of the bed portions 7 to 9. The loop-taker drive motor 67 is driven under control of a synchronous drive controller (not shown), so that the rotary hook is operated in synchronism with the vertical reciprocating movement of the needle bar.

A thread cutting mechanism (not shown) is provided at the distal end of each of the bed portions 7 to 9, which has a swingably movable blade for cutting a needle thread and a bobbin thread in cooperation with a fixed blade. The thread cutting mechanism is driven by a thread-cutting motor 69 (FIG. 2).

An outline of a control system for the multi-head embroidery sewing machine M having the above-mentioned mechanical construction will be described with reference to FIG. 2.

A machine control unit 30 for performing all the controls of the multi-head embroidery sewing machine M with the exception of a hook drive control is contained in the control box 20. The machine control unit 30 is made up of a microcomputer including a CPU 31, a ROM 32 and a RAM 33, and input and output interfaces (not shown) connected through buses, e.g., data buses, to the microcomputer. A plurality of drive circuits 34 to 39 are connected to the machine control unit 30.

The head portion 4 includes a needle-bar jumping solenoid 40 for driving the needle-bar jumping mechanism, a presser-foot driving solenoid 41, and a thread-breakage sensor 42. Those solenoids 40, 41 and the sensor 42 are connected to the machine control unit 30. The other head portions 5 and 6 are constructed similarly to the head portion 4.

The machine control unit 30 is connected to the drive circuit 36 for driving a machine motor 45, a first encoder sensor 46 for producing a plurality of slit signals per turn of a disk encoder attached to the machine motor 45, and a main-shaft origin sensor 47 for producing a single main-shaft sync signal per turn of the disk encorder detected by the first encoder sensor 46.

The machine control unit 30 is further connected to a stop-position sensor 48 for detecting a position where the needle bar stops, a display controller (DC) 56 for controlling the display operation of the display device 21, the drive circuit 37 for operatively driving a needle-bar changing motor 49 to move the needle bar cases 12, the drive circuit 38 for operatively driving an X-axis drive motor 50, the drive circuit 39 for operatively driving a Y-axis drive motor 51, an operation panel 52, the keyboard 22 through which characters, symbols and so on are entered, and a floppy disk controller (FDC) 54 for controlling a floppy disk drive (FDD) 53. A hard disk and a hard disk drive may be additionally provided.

The ROM 32 stores a sync control program for synchronizing the loop-taker drive motor 67 in operation with the machine motor 45, various control programs for the embroidering operations of the embroidering units M1 to M3, control programs for the control of sewing-condition setting and sewing operations, which is a feature of the present invention (described later), and so on. The program for the control of sewing-condition setting and sewing operations, which is stored in a memory medium such as a floppy disk, a CD-ROM, and a MO (magneto-optical) disk, may be installed in a hard disk.

A floppy disk 55, removably set to the FDD 53, stores pattern data indicative of a number of categorized embroidery patterns (the pattern data includes sewing data, thread-color change data, and others), and various control programs (for pattern select process, pattern editing process, display control on the display 21, embroidery data processing control, etc.).

A hook-shaft control unit 60, connected to the machine control unit 30, performs the rotary hook drive control and the thread breakage control. The hook-shaft control unit 60 is made up of a microcomputer including a CPU 61, a ROM 62 and a RAM 63, and input and output interfaces (not shown) connected through buses, e.g., data buses, to the microcomputer. Drive circuits 64 and 65 are connected to the hook-shaft control unit 60.

The bed portions 7 to 9 are connected to the hook-shaft control unit 60. Those bed portions 7 to 9 have substantially the same hardware arrangements, and hence the hardware arrangement of the bed portion 7 will typically be described. As shown, the bed portion 7 includes the drive circuit 64 for a loop-taker drive motor 67, a second encoder sensor 68, and a hook-shaft origin sensor 66. The second encoder sensor 68 produces a plurality of slit signals per turn of a disk encoder attached to the loop-taker drive motor 67. The hook-shaft origin sensor 66 produces a single hook-shaft sync signal per turn of the disk encoder.

The drive circuit 65 for the thread-cutting motor 69 is connected to the hook-shaft control unit 60.

The origin positions in the movements of the movable frame 16 and each of the embroidering frames 17 will briefly be described.

Figure 3:
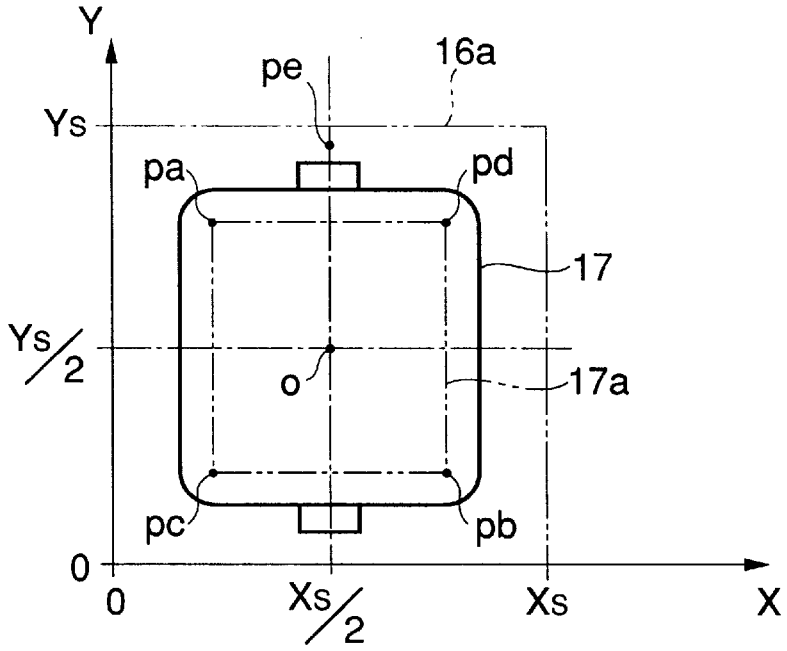
FIG. 3 is a diagram for explaining the origin positions in the movements of a movable frame and an embroidering frame of the sewing machine.

Reference is made to FIG. 3. The movement of the movable frame 16 in the X-axis and Y-axis directions is the same relative to a needle position of each of the embroidering units M1 to M3. In an X-Y coordinates system illustrated, Xs is a maximum movement distance in the X-axis direction; Ys is a maximum movement distance in the Y-axis direction; Xs/2 is a neutral position in the X-axis direction; Ys/2 is a neutral position in the Y-axis direction; and O is an origin position of the movable frame 16 relative to the needle position. The origin position of the movable frame 16 lies at an intersection of the prolongations from the neutral positions Xs/2 and Ys/2. In the present embodiment, the movable range of each of the embroidering frames 17 is contained in the movable range of the movable frame 16, and the origin position of each of the embroidering frames 17 is coincident with the origin position O of the movable frame 16. A sewing-condition setting control routine, which is executed by the machine control unit 30, will be described with reference to FIG. 4.

In the figure, Si (i=10, 11, 12 . . . ) indicates each procedural step of the routine.

Upon operation of a value-setting key included in the keyboard 22, the control routine starts. A setting screen is displayed on the display device 21 (step S10), with which a plurality of parametric items can be set.

The setting screen in this embodiment indicates first to fifth parametrical items "Embroidering frame number", "Sewable area", "Stand-by position", "Thread-cutting sensitivity", and "Number of stitch-back stitches" to be set, blank portions into which values for the parametrical items "Embroidering frame number", "Thread-cutting sensitivity", and "Number of stitch-back stitches" can be entered, and a window containing an embroidering frame 17, with which the parametrical items "Sewable area" and "Stand-by position" can be designated. The indicated parametrical items "sewable area" and "stand-by position" are related to the material feeding operation, and the parametrical items "thread-cutting sensitivity" and "number of stitch-back stitches" are related to the sewing operation.

Those parametrical items will be described briefly. The "embroidering frame number" designates the frame number of the embroidering frame 17 having a preset embroidering area and a preset shape, and is set in terms of a frame number. The "sewable area" designates an actually embroidery-sewable rectangular area within the embroidering frame 17 specified by the "embroidering frame number". The "stand-by position" designates a position to which the embroidering frame 17 is to be retracted after the embroidering operation is complete, and is set in terms of a needle position. The "thread-cutting sensitivity" designates a thread-breakage sensitivity used to determine whether or not a thread breakage sensed by a sensor is reliable, and is set in terms of the number of stitches (when the needle advances by an amount corresponding to the set number after the thread breakage-sensor detects the thread breakage, the thread-breakage sensor acts again to confirm whether the thread breakage actually occurs). The "number of stitch-back stitches" is the number of stitches for the stitch back, which corresponds to the number of idle stitches subsequent to the thread breakage, and is set in terms of the number of stitches.

Figure 5:
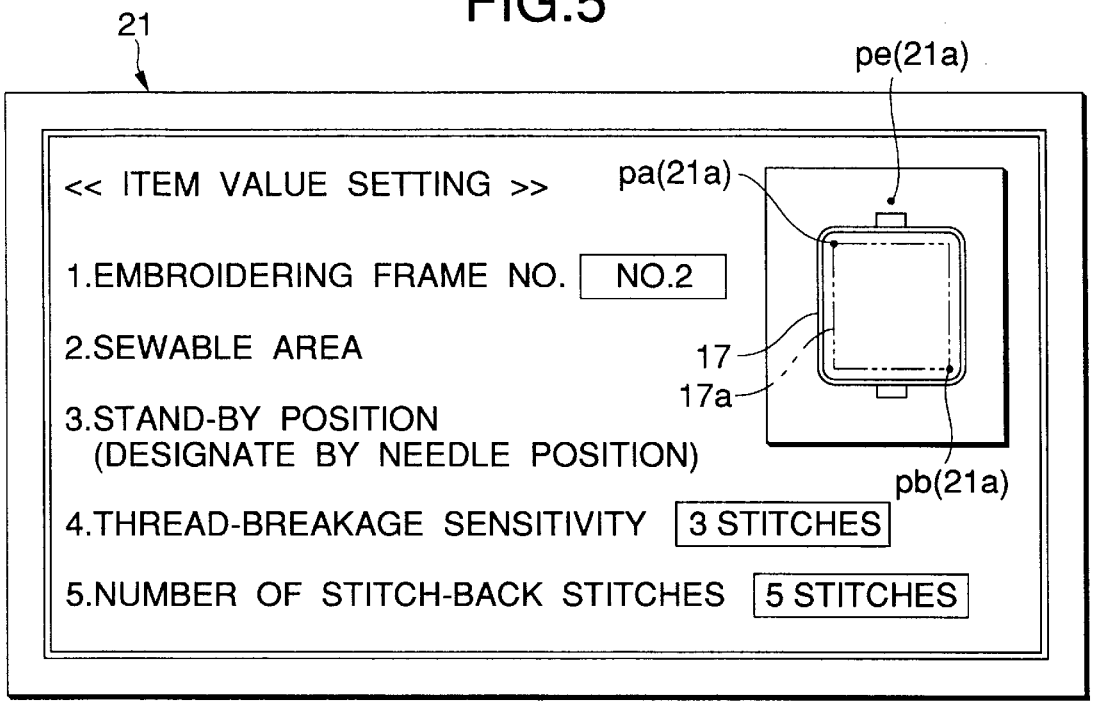
FIG. 5 is a diagram showing a display containing a set of parametrical items, which is used for setting the values for the parametrical items.

A process of setting the values for the respective parametrical items is executed (step S11). In FIG. 5, the "embroidering frame number" is set as "No. 2". The "sewable area" is set in such a manner that two positions, the left upper corner position pa and the right lower corner position pb, are designated with a cursor 21*a* to define the sewable area 17*a* within the embroidering frame 17. The "stand-by position" is set in such a manner that a position pe of the sewing needle 11 corresponding to a stand-by position of the embroidering frame 17 is designated in the window with the cursor 21*a*. The "thread-cutting sensitivity" and the "number of stitch-back stitches" are set as "3 stitches" and "5 stitches", respectively.

A set of values thus set for the parametrical items is registered in terms of a name assigned thereto (step S12). A specific example of registering the name will be described with reference to FIG. 6. After the necessary parametrical items are set completely, a new item "registered name" and an associated blank portion appear on the screen. A desired name, such as "T-shirt (L)" in this embodiment, can be assigned to the set of values by entering the name into the blank portion using character keys and/or numeral keys on the keyboard 22. In this embodiment, a desired name up to eight (8) characters can be entered into the blank portion. Any desired name constructed by one or combination of number, symbol, character, etc. can be assigned to the set of values as long as the name distinguishes the set or group of the values from other sets or groups of values. Upon depression of an enter key, the name assigned to the set of values is registered, and the registered name is stored in the floppy disk 55 in relation to the set of values which has already set for the parametrical items (step S13).

Figures 7, 8:
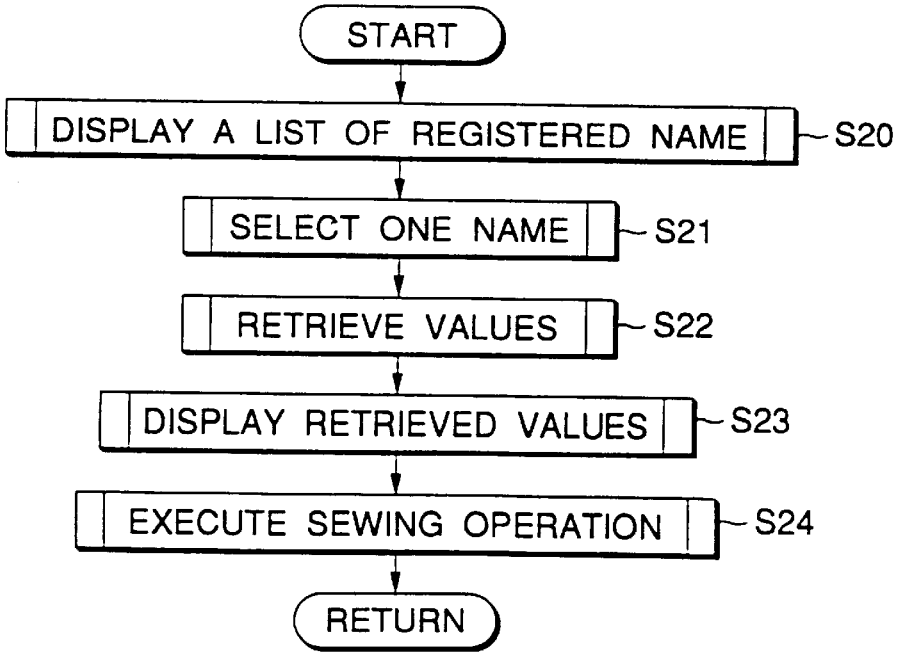
FIG. 7 is a diagram showing a data structure in which the values of a set of parametrical items are associated with the name assigned to the set of parametrical items.
FIG. 8 is a flowchart showing a sewing operation control routine.

For example, as shown in FIG. 7, the registered name "T-shirt (L)" and the related set of values set for the four parametrical items are stored in a predetermined memory area 55*a* of the floppy disk 55 as the content of the setting for a first group. Every time when the sewing condition setting process and the name registration process are executed, the registered names and the set of values for the parametric items are stored into the memory area 55*a* as the content of the setting for a second group, the content of the setting for a third group, . . . , in a successive manner. In addition, as shown in FIGS. 3 and 7, the "sewable area" is stored in terms of positional data of four corner points (pa, pb, pc, pd) of the rectangular sewable area 17*a,* and the "stand-by position" is stored in terms of positional data of the needle position pe.

In addition, the registered name and the set of values for the parametrical items may be stored in a hard disk.

An operation control routine for reading out or retrieving the set of values stored in relation to the registered "name" and executing the sewing operation based on the retrieved values will be described with reference to a flow chart of FIG. 8.

When a set-value retrieving key on the keyboard 22 is depressed under this operation control, a list of registered names is displayed on the screen of the display device 21 (step S20). Then, an operator selects a desired name from those listed ones by designating the desired name with the cursor 21*a* through the operation of a cursor moving key (step S21).

Figure 6:
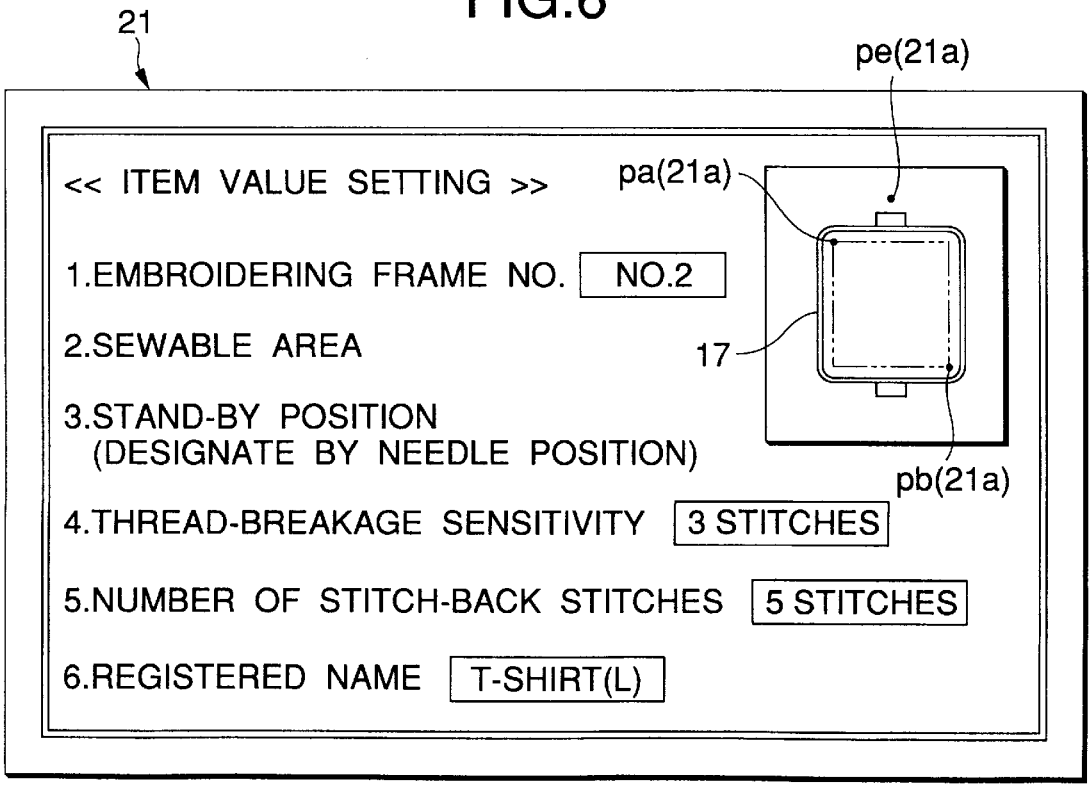
FIG. 6 is a diagram showing a display containing a set of parametrical items and an additional item of "name" assigned to the set of parametrical items.

The set of values set for the parametrical items and stored in relation to the selected, registered name are retrieved from the memory area 55*a* (step S22). The retrieved values are stored in a work memory of the RAM 33, and concurrently displayed on the display device 21 together with their parametrical items (step S23). For example, as shown in FIG. 6, the parametrical items and their values are displayed in a corresponding fashion. An embroidery pattern is embroidered on a material attached to the embroidering frame 17 in accordance with the pre-selected embroidery pattern data, using the retrieved values set for the parametric items (step S24).

During the sewing operation control routine, the values stored in the work memory of the RAM 33 are partially or entirely transferred or supplied to the sewing operation control as the need arises, for instance, when the embroidering frame 17 is drivingly moved, a thread breakage occurs, etc. That is, a part of the sewing operation control and/or a part of the retrieving control can form data transfer means or step.

Figure 4:
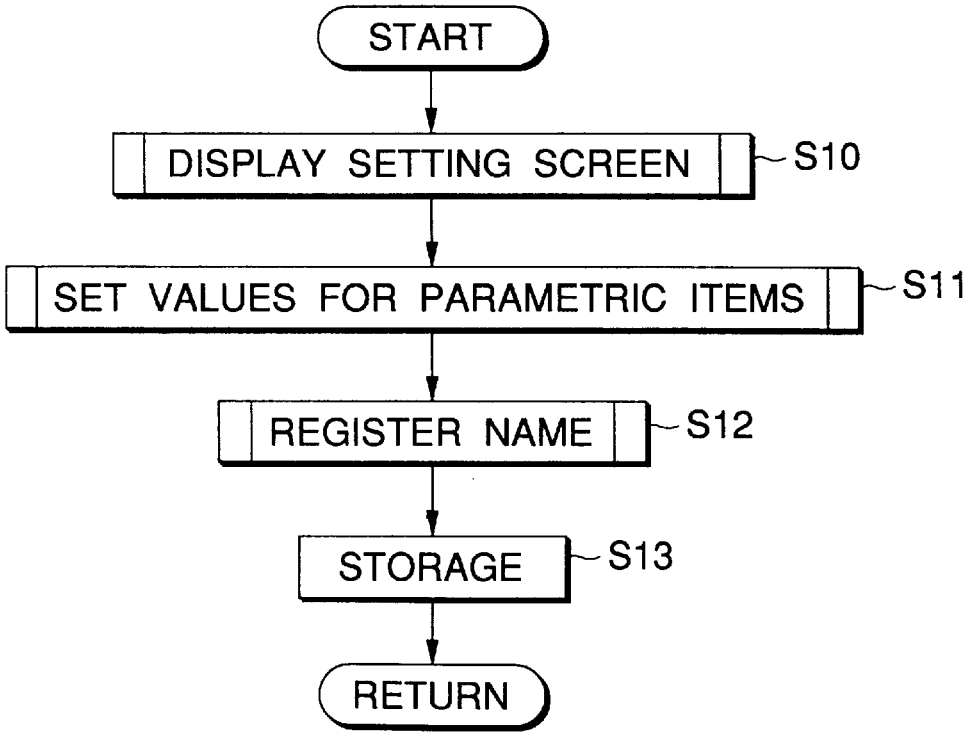
FIG. 4 is a flow chart showing a sewing-condition setting control routine.

The steps S10, S11, etc. in the sewing-condition setting control shown in FIG. 4 can form value setting means or step, and the steps S12, S13, etc. in the control shown in FIG. 4 can form name registering means or step. The steps S20, S21, etc. in the sewing-operation control can form name select means or step, and the steps S22, S23, etc. in the control shown in FIG. 8 can form retrieving means or step.

The value setting process for setting the plurality of values for the parametrical items and the retrieving process for retrieving the plurality of the values using the name related to those values, which are executed in the machine control unit 30, provide the following advantages.

The value setting screen displayed by the display device 21 indicates the parametrical items about the movement of the embroidering frame 17, i.e., "sewable area" and "stand-by position", as well as the parametrical items about the sewing operation, i.e., "thread-breakage sensitivity" and "number of stitch-back stitches". The operator enters or designates optimum values for those parametrical items by operating the numerical keys and the cursor moving keys on the keyboard 22, and registers a name to be assigned to the set of values for those parametrical items. The set of values for those parametrical items are stored in the floppy disk 55 in relation to the registered name.

Therefore, it is possible to dispense with the setting operation in which the optimum values for a plurality of the parametrical items depending on a material to be sewn are set one by one every time before the material is sewn. That is, by simply designating one of the registered names correspondingly to the material to be sewn, the optimum values for the parametrical items are retrieved simultaneously from the memory and set for the sewing operation. The accurate, simple and speedy setting of the values for the parametrical items can be achieved to improve the efficiency of the entire sewing work.

The values for the parametrical items to be set and stored as the sewing conditions include a value specifying a sewable area within the embroidering frame 17, and a value specifying the stand-by position of the embroidering frame 17 after the sewing operation is complete. Therefore, it is possible to dispense with the complicated setting operation that is generally required in setting these values, to facilitate preparatory work for the embroidering, and to achieve the efficient embroidering work.

The values for the parametrical items to be set and stored as the sewing conditions include a value designating the number of stitches for a thread-breakage sensitivity, and a value designating the number of stitch-back stitches when the sewing operation is interrupted due to the thread-breakage. Therefore, it is possible to dispense with the setting operation for these values, facilitate preparatory work for the embroidering and achieve the efficient embroidering work.

The parametrical items to be set and stored as the sewing conditions may include the parametrical items regarding the material feeding operation such as "sewing start position" and "sewing speed", or various kinds of items regarding the sewing operation other than the above-mentioned parametrical items.

It should be understood that the sewing operation control procedure and the sewing-condition setting control procedure described in connection with the embodiment are examples, and hence those may be modified, altered and changed without departing from the spirit of the present invention.

What is claimed is:

1. A control system for a sewing machine having input means for inputting characters, symbols and various commands, display means including a display unit, material feeding means for feeding a material to be sewn, sewing means for sewing said material, and control means for controlling said display means, said material feeding means, and said sewing means, said control system comprising:

value setting means for setting a value of each group for at least one parametrical item with respect to at least one of material-feeding and sewing operations using said input means and said display means;

name registering means for registering a user-entered name assigned to said value of said each group for said at least one parametrical item using said input means and said display means;

value storing means for storing said value of said each group for said at least one parametrical item in relation to said name thus registered by said registering means;

name selecting means for selecting one of a plurality of names, each of said plurality of names being stored in said storing means in relation to said value of a corresponding group for said at least one parametrical item; and retrieving means for retrieving, from said storing means, said value of a group corresponding to said selected name for said at least one parametrical item.

2. A sewing machine control system according to claim 1, further comprising:

transferring means for transferring said value of said group retrieved by said retrieving means to said control means.

3. A sewing machine control system according to claim 1, wherein said sewing machine includes an embroidery sewing machine capable of forming an embroidery pattern on said material mounted on an embroidering frame.

4. A sewing machine control system according to claim 3, wherein said at least one parametrical item includes at least one of a sewable area, a stand-by position, a thread-breakage sensitivity, a number of stitch-back stitches, a sewing start position, and a sewing speed.

5. A sewing machine control system according to claim 1, wherein said selecting means selects said one of said plurality of names by displaying a list of said plurality of names on said display unit and designating said one of said plurality of names on said display.

6. A method of controlling a sewing machine, said method comprising the steps of:

setting a value of each group for at least one parametrical item with respect to at least one of material-feeding and sewing operations;

registering a user-entered name assigned to said value of said each group for said at least one parametrical item;

storing said value of said each group for said at least one parametrical item in relation to said name thus registered;

selecting one of a plurality of names, each of said plurality of names being stored in relation to said value of a corresponding group for said at least one parametric item; and retrieving said value of a group corresponding to said name thus selected for said at least one parametrical item.

7. A method according to claim 6, further comprising the step of:

using said value of said group thus retrieved to control said sewing machine.

8. A method according to claim 6, wherein said at least one parametrical item includes at least one of a sewable area, a stand-by position, a thread-breakage sensitivity, a number of stitch-back stitches, a sewing start position, and a sewing speed.

9. A method according to claim 6, wherein said selecting step includes displaying a list of said plurality of names on said display unit and designating said one of said plurality of names on said display.

10. A method of setting a sewing condition applicable to a control for a sewing machine, said method comprising the steps of:

displaying a setting screen on a display to indicate at least one parametrical item with respect to at least one of material-feeding and sewing operations;

setting a value for said at least one parametrical item;

relating said value to one of groups by assigning a user-entered name to said value; and storing said value and said name in a storage medium.

11. A method according to claim 10, wherein said steps of displaying, setting, relating and storing are repeated to store said value and name of each of said groups in said storage medium.

12. A method according to claim 10, further comprising the steps of:

adding a blank portion on said display if setting of said value is complete; and entering said name to be assigned to said value into said blank portion.

13. A method of handling a sewing condition applicable to a sewing machine having a storage medium in which values of a plurality of groups for at least one parametrical item with respect to at least one of material-feeding and sewing operations are stored in relation to user-entered registered names, each of said registered names corresponding to each of said plurality of groups, said method comprising the steps of:

indicating a list of said registered names on a display;

selecting one registered name from said list;

retrieving, from said storage medium, a value of a group corresponding to said registered name thus selected; and controlling said sewing machine using said value of said group thus retrieved.

14. A method according to claim 13, further comprising:

displaying said value of said group thus retrieved on said display.

15. A storage medium storing therein a program for executing a method of controlling a sewing machine, said method comprising the steps of:

setting a value of each group for at least one parametrical item with respect to at least one of material-feeding and sewing operations;

registering a user-entered name assigned to said value of said each group for said at least one parametrical item;

storing said value of said each group for said at least one parametrical item in relation to said name thus registered;

selecting one of a plurality of names, each of said plurality of names being stored in relation to said value of a corresponding group for said at least one parametric item; and retrieving said value of a group corresponding to said name thus selected for said at least one parametrical item.

16. A sewing condition setting and handling device comprising:

an input device through which characters, symbols and various commands can be entered;

a display;

a control unit connected to said input device and said display, said control unit including:

a first storage device in which first and second programs are stored, wherein said first program is designed to execute a sewing condition setting method including the steps of:

displaying a setting screen on said display to indicate at least one parametrical item with respect to at least one of material-feeding and sewing operations;

setting a value for said at least one parametrical item, which is entered through said input device;

relating said value to one of groups by assigning a user-entered name to said value; and storing said value and said name as said one of groups;

wherein said second program is designed to execute a sewing condition handling method including the steps of:

indicating, on said display, a list of names, each of which is stored as one of said groups;

selecting one of said names from said list through said input device;

retrieving said value of a group corresponding to said name thus selected; and displaying, on said display, said retrieved value in relation to said at least one parametrical item;

a second storage device in which said value is stored in relation to said name assigned as said one of groups in accordance with said first program; and a central processing unit which controls said input device, said display, said first storage device and said second storage device in accordance with one of said first and second programs in response to a command entered through said input device.

17. A sewing condition setting and handling device according to claim 16, wherein said at least one parametrical item includes at least one of a sewable area, a stand-by position, a thread-breakage sensitivity, a number of stitch-back stitches, a sewing start position, and a sewing speed.

18. A sewing condition setting and handling device according to claim 16, wherein said first storage device includes a ROM, and said second storage device includes a floppy disk.

19. A sewing condition setting and handling device according to claim 16, wherein said first and second storage devices include a common hard disk.

20. A sewing condition setting and handling device according to claim 17, wherein said central processing unit sends said retrieved value to an embroidery sewing machine capable of forming an embroidery pattern on a material.

21. A control system according to claim 1, wherein a name registered by said registering means is constructed by at least one of a number, a symbol and a character, and can distinguish a corresponding group from other groups.

22. The sewing machine control system according to claim 1, wherein one group is differentiated from another group on the basis of at least one of a kind of material to be sewn and a size of an embroidery pattern to be sewn.

23. The method according to claim 6, wherein one group is differentiated from another group on the basis of at least one of a kind of material to be sewn and a size of an embroidery pattern to be sewn.

24. The method according to claim 10, wherein one group is differentiated from another group on the basis of at least one of a kind of material to be sewn and a size of an embroidery pattern to be sewn.

25. The method according to claim 13, wherein one group is differentiated from another group on the basis of at least one of a kind of material to be sewn and a size of an embroidery pattern to be sewn.

26. The storage medium according to claim 15, wherein one group is differentiated from another group on the basis of at least one of a kind of material to be sewn and a size of an embroidery pattern to be sewn.

27. The sewing condition setting and handling device according to claim 16, wherein one group is differentiated from another group on the basis of at least one of a kind of material to be sewn and a size of an embroidery pattern to be sewn.

* * * * *